US007898903B2

(12) United States Patent
Marchetti et al.

(10) Patent No.: US 7,898,903 B2
(45) Date of Patent: Mar. 1, 2011

(54) COMBINED PROBE AND CORRESPONDING SEISMIC MODULE FOR THE MEASUREMENT OF STATIC AND DYNAMIC PROPERTIES OF THE SOIL

(75) Inventors: Silvano Marchetti, Rome (IT); Diego Marchetti, Rome (IT)

(73) Assignee: Silvano Marchetti, Rome (IT)

( * ) Notice: Subject to any disclaimer, the term of this patent is extended or adjusted under 35 U.S.C. 154(b) by 0 days.

(21) Appl. No.: 12/057,963

(22) Filed: Mar. 28, 2008

(65) Prior Publication Data

US 2009/0245018 A1 Oct. 1, 2009

(51) Int. Cl.
*G01V 1/00* (2006.01)

(52) U.S. Cl. ..... 367/14

(58) Field of Classification Search ..... 367/14, 367/27, 191; 73/84; 340/853.3–853.5, 854.4, 340/854.6, 854.9, 855.1, 855.2, 855.6; 166/342, 166/344, 356, 65.1; 439/198, 207, 208, 210
See application file for complete search history.

(56) References Cited

U.S. PATENT DOCUMENTS 4,043,186 A * 8/1977 Marchetti ..... 73/84
6,670,880 B1 * 12/2003 Hall et al. ..... 336/132
7,273,102 B2 * 9/2007 Sheffield ..... 166/297
2008/0236809 A1 * 10/2008 Livingstone ..... 166/60
2008/0314593 A1 * 12/2008 Vinegar et al. ..... 166/302
2009/0034368 A1 * 2/2009 Johnson ..... 367/83

OTHER PUBLICATIONS

Robertson et al. "Seismic CPT to measure in-situ shear wave velocity", ASCE Geotechnical Eng Journal, V 112, No. 8, Aug. 1986, pp. 791-804. http://www.civil.ubc.ca/people/faculty/campanella/publications/043-Seismic%20CPT%20to%20Measure%20Shear%20Wave%20Velocity-ASCE-JGE-86.pdf.*
Hepton P. 1988. Shear wave velocity measurements during penetration testing. Proc. Penetration Testing in the UK, ICE, 275-278.
G.K. Martin and P.W. Mayne, 1998 Seismic flat dilatometer tests in Piedmont residual soils, 837-842.
Leonards, G. A., et al.; "Settlement of Shallow Foundations on Granular Soils," Journal of Geotechnical Engineering, col. 114, No. 7, pp. 791-809 (Jul. 1988).
Failmezger, R. A., "Which in-situ test should I use?—a designer's guide," Ohio River Valley Soils Seminar 39, Cincinnati, Ohio (2008).

* cited by examiner

*Primary Examiner*—Jack Keith
*Assistant Examiner*—Krystine Breier
(74) *Attorney, Agent, or Firm*—Ladas & Parry, LLP

(57) ABSTRACT

A combined probe includes a dilatometer probe, a gas conduit coupled to the dilatometer probe for providing a gas connection between the dilatometer probe and an external gas source, a wire located in the gas conduit for providing an electrical connection between the dilatometer probe and an external circuit, and a seismic module coupled to the wire located in the gas conduit to provide an electrical connection between the seismic module and the external circuit.

26 Claims, 3 Drawing Sheets

COMBINED PROBE AND CORRESPONDING SEISMIC MODULE FOR THE MEASUREMENT OF STATIC AND DYNAMIC PROPERTIES OF THE SOIL

TECHNICAL FIELD

This disclosure relates to a combined seismic probe and corresponding seismic module for the measurement of static and dynamic proprieties of the soil.

BACKGROUND

A known probe 1 for measuring in situ the deformation moduli of the soil layers, commonly referred to as a Flat Dilatometer, is known from U.S. Pat. No. 4,043,186. This probe 1, shown in FIG. 1, comprises a dilatometer blade 2 having inside a pressure chamber in communication with the outside via an opening sealed by a thin circular expandable steel membrane 3 mounted flush on one face of the blade (or equipped with two membranes, one on each face of the blade). The probe is forced vertically into the ground by push rods 4 connected above the blade 2. The dilatometer blade 2 also comprises electrical contacts acting in response to the movement of said metal membrane. The blade 2 is connected to the surface by an internally wired gas conduit 5,6 comprising a gas conduit 5, for example a plastic tube, containing a single wire 6, which runs inside the push rods 4. The gas conduit 5 is connected, at the soil surface, to an external circuit comprising an unit for introduction and removal of compressed gas to and from the chamber dilatometer blade 2, while the single wire 6 allows the electrical communication from the blade 2 to the external circuit. At selected depths the blade 2 is stopped and the membrane 3 is inflated by feeding gas pressure to the blade 2. At each depth the user determines the pressure Po which is the pressure causing the initial lift-off of the membrane, and subsequently the pressure P1 which is the pressure producing a central displacement of the membrane by a predetermined amount, generally 1.1 mm. The instants at which Po and P1 have to be taken are signaled by the opening or the closure of a circuit, determined by the position of the membrane, which works like an ordinary electrical switch. The two poles of the switch are connected to the surface by the live wire inside the gas conduit and the electrical earth i.e. the pushrods. On the surface, a battery and a buzzer (emitting a sound when the circuit is closed) complete the circuit. The two pressures Po and P1 are then interpreted to derive soil parameters.

The known Flat Dilatometer probe has been increasingly used in recent decades. However the Flat Dilatometer determines only static soil parameters, while today there is also a growing interest in seismic parameters, in particular in the shear wave velocity Vs and in the initial shear modulus Go (derivable from Vs).

Various methods are currently available for determining the Vs profile. Among these, frequently used methods are the Cross-Hole and the Down-Hole method, carried out in specially made dedicated boreholes. However these methods require additional field work, hence the global cost and time are substantially higher compared with a situation wherein static and seismic parameters are obtained from just one sounding with the same probe.

This is the reason why research efforts have been carried out in the past (Hepton "Shear Wave Velocity Measurements during Penetration Testing", Proc. Penetration Testing in the UK, ICE1988, pages 275-278, and G. Martin and P. Mayne "Seismic Flat Dilatometer Tests in Piedmont Residual Soils" Geotechnical Site Characterization 1998 Balkerna, Rotterdam) to combine the Flat Dilatometer with a seismic module for obtaining at the same time the static and seismic parameters.

FIG. 2 shows a known experimental composite probe equipped with a seismic module 7. The seismic module 7 comprises a tubular element 4*a*, for example a steel tube, connected above the dilatometer blade 2. Inside this tubular element 4*a*, two receivers 8, 9, for example geophones or accelerometers are placed, spaced typically 0.5 m or 1 m apart.

Each receiver 8, 9 is connected to the surface by a respective wire 10, 11. Each of these wires 10, 11 runs inside the push rods 4 in parallel to the internally wired gas conduit 5,6. Both the internally wired gas conduit 5,6 and the seismogram wires 10, 11 reach the surface and are connected to an external circuitry.

The composite probe 12, formed by the seismic module 7 and the dilatometer blade 2, is forced vertically into the soil by push rods 4 connected above the tubular element 4*a* of the seismic module 7. At the desired depths the probe 12 is stopped and the operator can either perform measurements of static soil parameters—as described above—or can perform a Vs measurement.

At the depths where the Vs measurements have to be carried out, the probe 12 is stopped and a seismic wave W is generated at ground surface by a source, often a pendulum hammer which hits horizontally a parallelepiped anvil. The seismic wave W propagates downwards and reaches first the upper receiver 8, then the lower receiver 9. The delay between the first and second seismogram is generally determined using the well known cross-correlation algorithm.

Once the delay is known, the shear wave velocity Vs is obtained as the ratio between the easily calculated difference in distance between the source at the surface and the two receivers and said delay. Vs may then be converted into Go, the initial soil shear modulus, by using the theory of elasticity formula $Go=\rho Vs^2$.

When the combined probe 12 is used for static measurement, the Flat Dilatometer works as previously described and is connected to the surface by its internally wired gas conduit 5,6.

The seismic module 7 transmits in analog form to the surface the electrical seismograms generated by the two receivers 8,9 via wires 11, 10. The seismograms are analyzed at the surface by an oscilloscope to determine the delay.

Such combined probes 12 have produced interesting research results. In particular the obtained results have been the starting point of studies aimed at combining the low strain shear modulus (from the Seismic test) and the operative modulus (from the Flat Dilatometer) for defining the decay curves of modulus versus strain, necessary to perform non linear analysis of the soil deformation under load.

However, the known combined probe 12 has a number of serious practical drawbacks for industrial use in the field of the soil investigations.

One inconvenience is that the wires 10, 11 transmitting the seismograms in an analog form act like antennas and pick up electrical disturbance due to traffic, motors, electrical lines, telecommunication lines and the like. This inconvenience is especially grave at large depths, where the seismograms are weak—due to the distance from the energizing source—and the electrical noise can obscure the signal running on the wires 10, 11.

An even more serious practical inconvenience is the presence of multiple cabling. The presence of more than one cable, in particular either the internally wired gas conduit 5,6, and the wires 10, 11, enormously complicates field testing, as it is well known to experienced operators. The cables 5, 6, 10, 11 have to be threaded inside the push rods 4 and frequently manipulated. The risk of garbling and mixing up two (or more) cables is high, resulting in considerably slower operations and considerably higher overall costs.

In the case of deep investigations in the ground, several cables 5,6, 10, 11 must be must be connected in sequence to obtain the necessary length. The junctions become numerous and the multiple joints, pneumatic and electrical are highly complicated and voluminous.

In the special case of offshore investigations, which are very important to industry, the use of a multiplicity of wire or cables is virtually impossible. In fact in many offshore configurations, the dilatometer blade 2 connected to the internally wired gas conduit 5,6 is suspended by a rope that is even difficult to handle with just a single cable or conduit because the suspended dilatometer blade 2 can rotate, thereby twisting the internally wired gas conduit 5,6, while the rope and the internally wired gas conduit 5,6 must freely slide longitudinally independently of each other, in order to allow the insertion of the dilatometer blade 2 in the soil at the bottom of the sea. It is a well known fact that operators are in many cases obsessed by the problems posed by the presence of wires.

The overcoming of these inconveniences, in particular the multiple wire problem and advantageously the antenna effect, are solved by the embodiments of the present disclosure.

SUMMARY

In a first embodiment disclosed herein a combined probe includes a dilatometer probe, a gas conduit coupled to the dilatometer probe for providing a gas connection between the dilatometer probe and an external gas source, a wire located in the gas conduit for providing an electrical connection between the dilatometer probe and an external circuit, and a seismic module coupled to the wire located in the gas conduit to provide an electrical connection between the seismic module and the external circuit.

In another embodiment disclosed herein a seismic module comprises a tubular element, a gas conduit located within the tubular element, and a wire located in the gas conduit to provide an electrical connection between the seismic module and the external circuit, wherein the wire and the gas conduit are adapted for coupling to a dilatometer probe.

BRIEF DESCRIPTION OF THE DRAWINGS

A more complete appreciation of the features and many of the attendant advantages thereof will be readily understood by reference to the following detailed description when taken in conjunction with the accompanying drawings in which.

DETAILED DESCRIPTION

Figure 1:
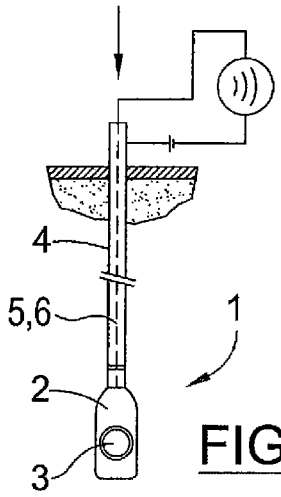
FIG. 1 shows a schematic view of a dilatometer probe in accordance with the prior art.
Figure 1A:
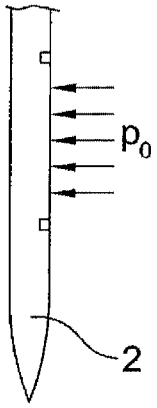
FIG. 1*a* shows a schematic side view of the dilatometer probe of FIG. 1 with the membrane in an unexpanded position.
Figure 1B:
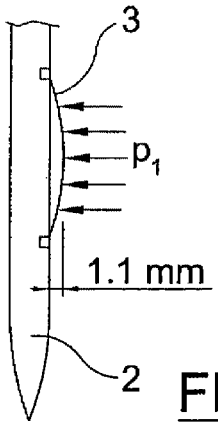
FIG. 1*b* shows a schematic side view of the dilatometer probe of FIG. 1 with the membrane in an expanded position.
Figure 2:
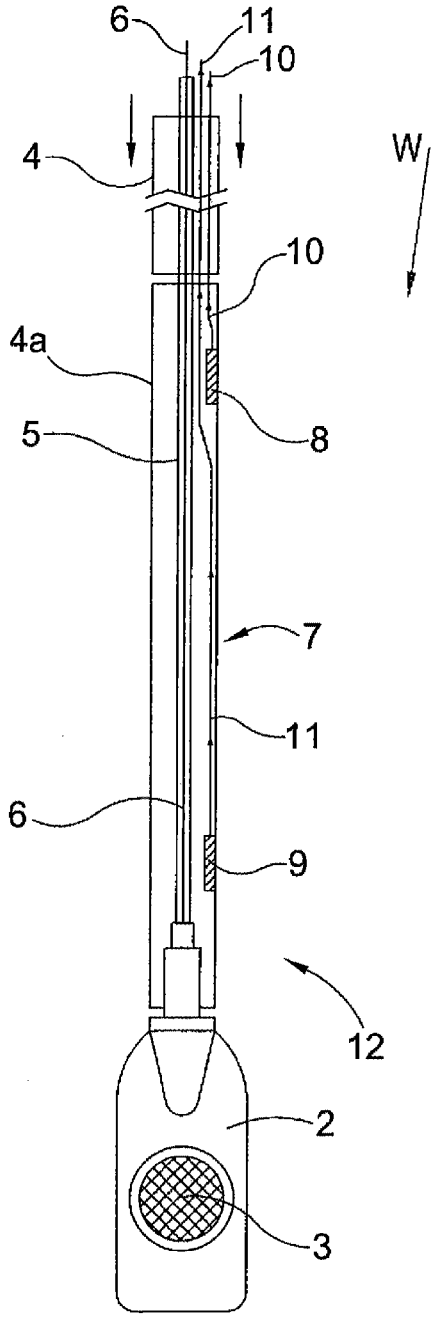
FIG. 2 shows a schematic view of a combined probe in accordance with the prior art.
Figure 3:
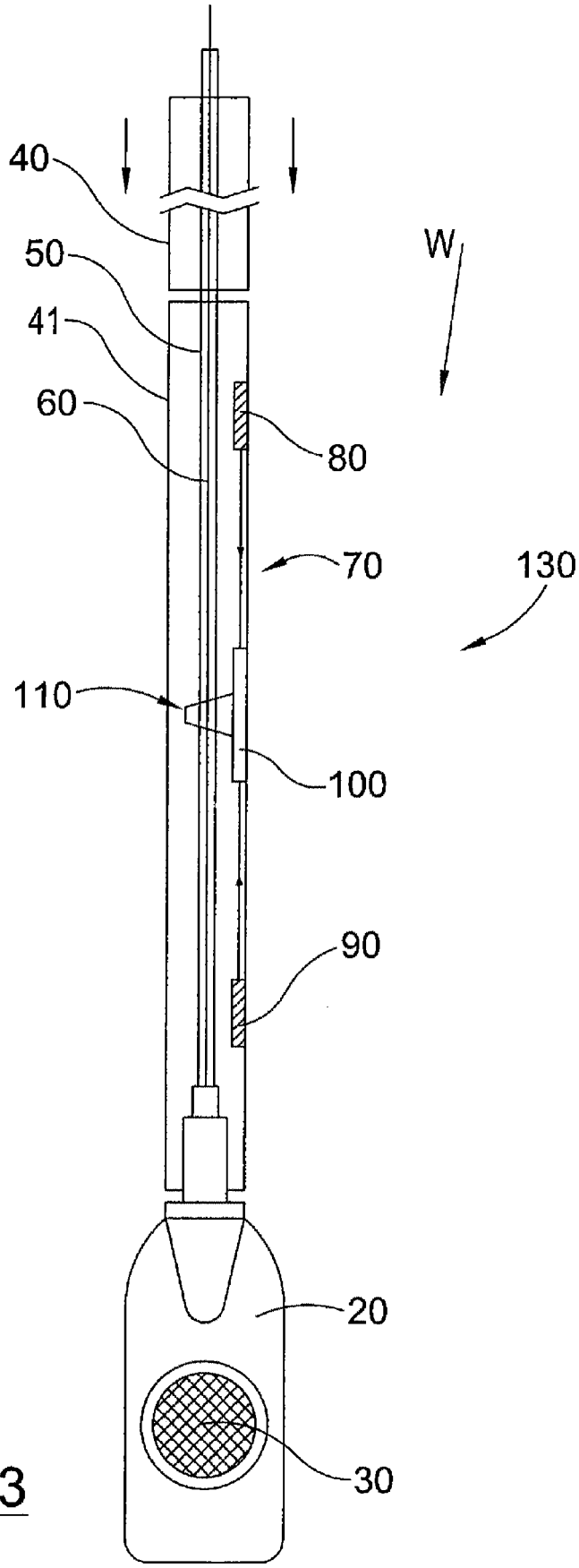
FIG. 3 shows a schematic view of a combined probe in accordance with the present disclosure.

Referring now to the drawings wherein like reference numerals describe identical or corresponding parts throughout the several views, and more particularly to FIG. 3, a combined probe 130 comprises a dilatometer probe 20 having inside a pressure chamber which communicates with the outside via at least one opening sealed by a membrane 30, gas being feedable into and removable from the pressure chamber to cause the membrane to move. For example, the gas can be air or nitrogen.

The combined probe 130 also comprises an internally wired gas conduit (50, 60) providing electrical and pneumatic connection between the dilatometer probe to an external circuit (not shown). In particular, the internally wired gas conduit comprises a gas conduit 50, for example a plastic tube, containing a wire 60. The gas conduit 50 permits the compressed gas to flow from the external circuit on the soil surface to the dilatometer probe 20, while the wire 60, for example a single wire, permits the exchange of electrical signals between the dilatometer probe 20 and the external circuit.

The combined probe 130 comprises a seismic module 70 that comprises a tubular element 41, for example a rigid tubular element 41, connectable to the dilatometer probe 20. Advantageously, the rigid tubular element 41 is a steel tube. Inside the tubular element 41, at least a seismic transducer element 80, 90, an electronic board 100 connected to the receivers 80, 90 are fixed. The internally wired gas conduit (50, 60) is inserted in the tubular element 41 before reaching the external circuit.

The electronic board 100 comprises a transmitter 110 to exchange the electrical signals between the electronic board 100 and the external circuit.

In one embodiment, the transmitter 110 is coupled to the wire 60 in order to exchange signals with the outside of the seismic module 70.

With the combined probe 130 it is possible to carry out both static measurements of the soil parameters using the dilatometer probe 20 and dynamic/seismic measurements of the soil parameters using signals originating from the seismic transducer element 80, 90.

In particular, both the dilatometer probe 20 and seismic module 70 use the internally wired gas conduit (50, 60) in order to exchange information with the outside of the combined probe 130.

Advantageously the only connection between the dilatometer probe 20 or the seismic module 70 and the external circuit is constituted by the internally wired gas conduit (50, 60), thereby avoiding the problems caused during field operations by the presence of multiple cables.

In order to obtain more detailed dynamic measurements of the soil parameters, a second seismic transducer element 80, 90 can be provided in the seismic module 70. The seismic transducer elements 80, 90 are receivers, for example geophones or accelerometers, spaced typically 0.5 m or 1 m apart.

Advantageously, the seismic module 70 and the dilatometer probe 20 are forced vertically into the soil by means of push rods 40 that are connected above the rigid tubular element 41.

In one embodiment, the electronic board 100 also comprises:

a receiver which receives signals originating from the seismic transducer element, and an analog/digital converter for amplifying and transforming the analog signals from the seismic transducer element 80, 90 into a digital signal.

In the embodiment shown in FIG. 3, the transmitter 110 is contactless and comprises, for example, a magnetic head with a C-shaped profile, in which the internally wired gas conduit (50,60) runs between the free arms of the magnetic head.

Figure 4:
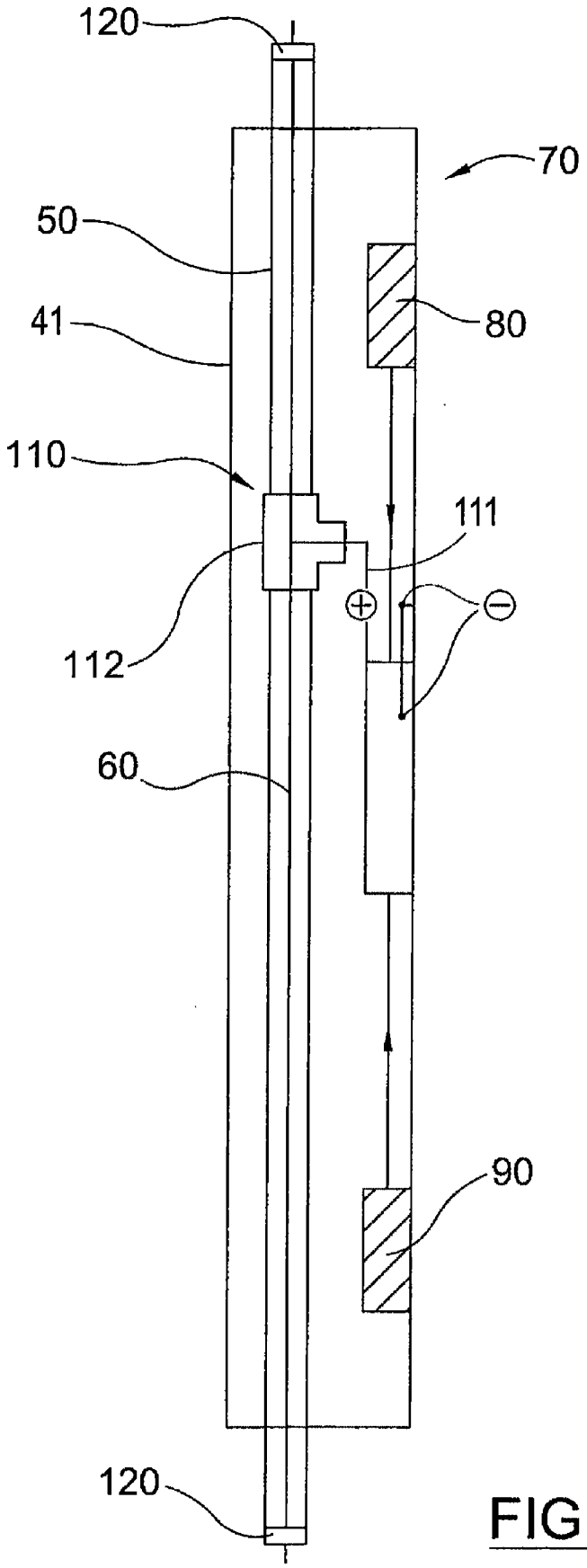
FIG. 4 shows a schematic view of an embodiment of a seismic module of the combined probe in accordance with the present disclosure.

In another embodiment shown in FIG. 4, the transmitter 110 comprises a wire 111 having a first end which is electrically connected to the electronic board 100, a second end which is electrically connected to the wire 60. The second end of the wire 111 is located in a pneumatic adaptor 112 which is sealedly closed with the internally wired gas conduit (50, 60). So the connection between the wire 111 and the wire 60 is sealedly inside the pneumatic adaptor 112, in order to permit the flow of compressed gas in the gas conduit (50, 60).

In other words, the second end enters in the internally wired gas conduit through the pneumatic adaptor so that compressed gas can freely flow in the internally wired gas conduit (50, 60). After that the conductor 111 is connected to the wire located in the gas conduit 50.

Advantageously, airtight connectors 120 are provided at the ends of the internally wired gas conduit (50,60) of the seismic module 70 in order to permit the connection to the dilatometer probe 20 and to a further internally wired gas conduit (50,60) of a dilatometer probe 20.

Also advantageously, the seismic module 70 can include geophones, accelerometers, inclinometers, video cameras, pressure transducers, visual sensors, chemical detectors connected to the electronic board. The electronic board 100 can also be formed by acquisition unit and a processor.

A seismic module 70, as for example those shown in FIGS. 3 and 4, comprises:

seismic transducer elements 80,90, an acquisition unit and a processor 100 for signals originating from the seismic transducer elements, and transmitter 110 is connected to the acquisition unit and processor 100.

Seismic modules 70 are suitable to contain an internally wired gas conduit (50, 60) for electrical and pneumatic connection, and are suitable to be connected to a dilatometer probe 20, hence define a combined probe 130. As previously described, the dilatometer probe 20 has inside a pressure chamber communicating with the outside via at least one opening sealed by a membrane 30. The internally wired gas conduit (50, 60) is connected and sealed to the pressure chamber, while a wire 60 located in the internally wired gas conduit (50, 60) is electrically connected to the dilatometer probe 20.

In the seismic module 70, the transmitter 110 is coupled to the wire 60 to permit the exchange of electric signals between the acquisition unit and the processor and the outside of the seismic module.

The combined probe 130 operates, for example, in the following manner. The outputs of the receivers 80, 90, rather than being sent directly to the surface as in the prior art, are sent to the electronic board 100 inside the seismic module 70. The electronic board 100 processes the signals, for example it amplifies and digitizes them. Then, rather than using additional wires to transmit the signals to the surface, the digitized signals are conveyed to the surface via the inner wire 60 used by the dilatometer probe 20. The digitized signals are decoded by the surface unit and analyzed to determine the delay, from which the shear wave velocity is computed.

Advantageously the digitization at depth avoids the antenna effect that would disturb the signals if they were transmitted directly from the transducers to the surface by wires in an analog form.

The double use of the inner wire 60 for both static and seismic measurements, enabling alternatively the dilatometer probe or the seismic module, is possible since the two tests are carried out at different times. The combined probe 130 makes the combined tool much simpler and economical to use.

Advantageously, the combined probe 130 can use the same internally wired gas conduit (50,60) as the dilatometer probe, this arrangement having various advantages. Users of the Flat Dilatometer probe do not need to procure additional cables and the manufacturer does not need to manufacture and have in stock different types of cables and joints (beneficial also from the ecological viewpoint).

Advantageously with the combined probe 130, the detected signals can transmit digitally, via the same inner wire 60, even those signals generated by other sensors included in the seismic module 70.

The presence of just one internally wired gas conduit (50, 60) permits very quick disassembly of the combined probe 130 if the seismic module 70 is removable. Thus, if only static measurements have to be carried out, the dilatometer probe and the seismic module can be quickly separated and the dilatometer probe be used in the usual non-seismic mode.

The modularity of the composite probe means that owners of the Flat Dilatometer probe, for example described in the U.S. Pat. No. 4,043,186, wishing to also carry out seismic measurements, do not need an integrated new probe but need only add-on the seismic module 70 of this disclosure to upgrade their Flat Dilatometer probe.

What is claimed is:

1. A probe assembly for attaching to a dilatometer probe, the dilatometer probe having a pressure chamber which communicates with the outside via at least one opening sealed by a membrane and a first internally wired gas conduit providing electrical and pneumatic connection to the dilatometer probe and an external compressed gas source, the first internally wired gas conduit including a first pressurized gas conduit coupled to the pressure chamber and containing compressed gas, and a first wire located in the first pressurized gas conduit transmitting electric signals, the probe assembly comprising a seismic module, the seismic module comprising:

a tubular element;

a second internally wired gas conduit located within the tubular element providing electrical and pneumatic connection between the dilatometer probe and an external circuit located at the soil surface, the second internally wired gas conduit comprising:

a second pressurized gas conduit configured to contain compressed gas inflated by the external compressed gas source and able to cause the membrane to move, a second wire located in the gas conduit, a connection to the first internally wired gas conduit comprising an electrical connection to the first wire, and airtight connections provided at the ends of the second internally wired gas conduit connecting to the dilatometer probe and to the first internally wired gas conduit;

at least one seismic transducer element configured to carry out dynamic or seismic measurements of soil parameters; and an electronic board connected to the seismic transducer element and comprising a transmitter capable of exchanging electric signals between the electronic board and the external circuit; and wherein the seismic module is arranged for transmitting through the second internally wired gas conduit:

all the electric and pneumatic signals to be exchanged between the dilatometer probe and the external circuit, and all the electric signals to be exchanged between the electronic board and the external circuit; and wherein the seismic module is arranged to transmit through the second wire all electric signals between the first wire, the electronic board and the external circuit.

2. The probe assembly of claim 1:

wherein the at least one seismic transducer element located in the tubular element; and wherein the probe assembly further comprises:

an acquisition unit located in the tubular element and coupled to the transducer element acquiring signals from the seismic transducer element; and a processor located in the tubular element and coupled to the acquisition unit, said processor configured to process the acquired signals from the seismic transducer element.

3. The probe assembly of claim 1 wherein the second wire located in the gas conduit is a single wire.

4. The probe assembly of claim 2 wherein the acquisition unit and the processor are on an electronic board.

5. The probe assembly of claim 2 wherein the acquisition unit comprises:

a receiver to receive analog signals originating from the seismic transducer element; and an analog/digital converter for amplifying and transforming the analog signals from the seismic transducer element into a digital signal.

6. The probe assembly of claim 1 wherein the transmitter coupled to the second wire for exchanging electric signals between the seismic module and the external circuit comprises a contactless electrical connection.

7. The probe assembly of claim 6 wherein the contactless electrical connection comprises a magnetic head.

8. The probe assembly of claim 7 wherein:

the magnetic head has a C-shaped profile having two free arms; and the gas conduit extends between the free arms of the magnetic head.

9. The probe assembly of claim 1 wherein the transmitter comprises:

a first end being electrically coupled to the seismic module; and a second end being electrically coupled to the second wire located in the gas conduit;

wherein the second end enters into the gas conduit through a pneumatic adaptor sealed so that gas can freely flow in the gas conduit to a dilatometer probe coupled to the seismic module.

10. The probe assembly of claim 1 wherein the seismic module comprises geophones, accelerometers, inclinometers, video cameras, pressure transducers, visual sensors, and chemical detectors.

11. The probe assembly of claim 1, wherein:

the second wire is the only electrical connection between the seismic module and the external circuit; and the second wire is the only electrical connection between the external circuit and a dilatometer probe coupled to the seismic module.

12. The probe assembly of claim 1, wherein:

the internally wired gas conduit is the only connection between the seismic module and the external circuit; and the internally wired gas conduit is the only connection between the external circuit and a dilatometer probe coupled to the seismic module.

13. A probe assembly comprising:

a seismic module, arranged to measure the dynamic properties of the soil and comprising a tubular element;

a dilatometer probe comprising a pressure chamber inside the dilatometer probe which communicates with the outside via at least one opening sealed by a membrane;

a transmitter;

an internally wired gas conduit providing electrical and pneumatic connection between the dilatometer probe, the seismic module and an external compressed gas source, the internally wired gas conduit comprising:

a pressurized gas conduit located within the tubular element and coupled to the dilatometer probe, the pressurized gas conduit configured to contain compressed gas inflated by the external compressed gas source and able to cause the membrane to move, and a wire located in the pressurized gas conduit configured to transmit electric signals between the dilatometer probe and an external circuit located at the soil surface;

wherein the transmitter is coupled to the seismic module and to the wire for exchanging electric signals between the seismic module and the external circuit, and wherein the probe assembly is arranged for transmitting through the wire:

the electric signals to be exchanged between the dilatometer probe and the external circuit, and the electric signals to be exchanged between the seismic module and the external circuit.

14. The probe assembly of claim 13 wherein the seismic module further comprises:

at least one seismic transducer element;

an acquisition unit coupled to the transducer element for acquiring signals from the seismic transducer element; and a processor coupled to the acquisition unit for processing the acquired signals from the seismic transducer element.

15. The probe assembly of claim 13 wherein the wire located in the gas conduit is a single wire.

16. The probe assembly of claim 13 wherein the gas conduit is located within a tubular element in which the seismic module is located.

17. The probe assembly of claim 14 wherein the gas conduit is located within a tubular element in which the seismic transducer element, the acquisition unit, and the processor are located.

18. The probe assembly of claim 14 wherein the acquisition unit and the processor are on an electronic board.

19. The probe assembly of claim 14 wherein the acquisition unit comprises:

a receiver to receive analog signals originating from the seismic transducer element; and an analog/digital converter for amplifying and transforming the analog signals from the seismic transducer element into a digital signal.

20. The probe assembly of claim 13 wherein the transmitter coupled to the wire for exchanging electric signals between the seismic module and the external circuit comprises a contactless electrical connection.

21. The probe assembly of claim 20 wherein the contactless electrical connection comprises a magnetic head.

22. The probe assembly of claim 21 wherein:

the magnetic head has a C-shaped profile having two free arms; and the gas conduit extends between the free arms of the magnetic head.

23. The probe assembly of claim 22 wherein the transmitter comprises:

a first end being electrically coupled to the seismic module; and a second end being electrically coupled to the wire located in the gas conduit;

wherein the second end enters into the gas conduit through a pneumatic adaptor which is sealed so that gas can freely flow in the gas conduit to the dilatometer probe.

24. The probe assembly of claim 13 wherein the seismic module comprises geophones, accelerometers, inclinometers, video cameras, pressure transducers, visual sensors, and chemical detectors.

25. The probe assembly of claim 13, wherein:

the wire is the only electrical connection between the seismic module and the external circuit; and the wire is the only electrical connection between the dilatometer probe and the external circuit.

26. The probe assembly of claim 13, wherein the probe assembly is arranged to transmit through the wire: any electric signals to be exchanged between the dilatometer probe and the external circuit, and any electric signals to be exchanged between the seismic module and the external circuit.

* * * * *